US007937769B2

(12) United States Patent
Richards

(10) Patent No.: US 7,937,769 B2
(45) Date of Patent: May 10, 2011

(54) KNEE PAD

(76) Inventor: Lee E. Richards, Whitefield, ME (US)

( * ) Notice: Subject to any disclaimer, the term of this patent is extended or adjusted under 35 U.S.C. 154(b) by 381 days.

(21) Appl. No.: 11/972,338

(22) Filed: Jan. 10, 2008

(65) Prior Publication Data

US 2008/0168589 A1 Jul. 17, 2008

Related U.S. Application Data

(60) Provisional application No. 60/880,314, filed on Jan. 12, 2007.

(51) Int. Cl.
*A41D 13/00* (2006.01)
*A41D 13/06* (2006.01)

(52) U.S. Cl. ..... 2/22; 2/24

(58) Field of Classification Search ..... 2/455, 456, 2/22, 23, 24, 231, 232, 233, 241, 267
See application file for complete search history.

(56) References Cited

U.S. PATENT DOCUMENTS

| | | | | | |
|---|---|---|---|---|---|
| 2,733,443 | A | | 2/1956 | Holder | |
| 3,465,365 | A | * | 9/1969 | Jones et al. | 2/24 |
| 3,761,960 | A | | 10/1973 | Woodcock | |
| 4,627,108 | A | * | 12/1986 | Jarvinen | 2/22 |
| 4,692,946 | A | | 9/1987 | Jurga | |
| 4,772,071 | A | | 9/1988 | Richards | |
| 4,876,745 | A | | 10/1989 | Richards | |
| 5,093,931 | A | * | 3/1992 | LaBerge et al. | 2/22 |
| 5,199,941 | A | * | 4/1993 | Makinen | 602/27 |
| 5,301,370 | A | | 4/1994 | Henson | |
| 5,384,913 | A | * | 1/1995 | Hendry | 2/22 |
| 5,452,475 | A | * | 9/1995 | Hunt, Jr. | 2/22 |
| 5,477,559 | A | * | 12/1995 | Clement | 2/22 |
| 5,507,720 | A | | 4/1996 | Lampropoulos | |
| 5,561,857 | A | * | 10/1996 | Hoshizaki et al. | 2/22 |
| 5,611,080 | A | * | 3/1997 | Skottheim | 2/16 |
| 5,625,896 | A | * | 5/1997 | LaBarbera et al. | 2/22 |
| 5,634,211 | A | * | 6/1997 | Chen | 2/22 |
| 5,662,594 | A | | 9/1997 | Rosenblatt | |
| 5,732,411 | A | | 3/1998 | Coleman et al. | |
| 5,742,938 | A | * | 4/1998 | Winningham et al. | 2/22 |
| 5,794,261 | A | * | 8/1998 | Hefling | 2/16 |
| 5,898,939 | A | | 5/1999 | Schramm | |
| 6,128,779 | A | * | 10/2000 | Goldsmith et al. | 2/22 |
| 6,178,556 | B1 | * | 1/2001 | Foreman et al. | 2/22 |
| 6,272,682 | B1 | * | 8/2001 | Fullum | 2/22 |
| 6,427,239 | B1 | | 8/2002 | Worden | |
| 6,553,572 | B2 | * | 4/2003 | Fiorini et al. | 2/22 |
| 6,637,034 | B1 | | 10/2003 | Worden | |
| 6,654,961 | B2 | | 12/2003 | Beland | |
| 6,795,974 | B1 | | 9/2004 | Howell | |
| 6,964,062 | B1 | * | 11/2005 | Chen | 2/22 |
| 7,188,370 | B2 | * | 3/2007 | Bevier | 2/22 |
| 2004/0083527 | A1 | * | 5/2004 | Budda | 2/22 |
| 2005/0114976 | A1 | * | 6/2005 | Beland et al. | 2/22 |
| 2008/0115248 | A1 | * | 5/2008 | Meadows | 2/22 |

* cited by examiner

*Primary Examiner* — Alissa L Hoey
(74) *Attorney, Agent, or Firm* — Patricia M. Mathers

(57) ABSTRACT

A knee pad with a support frame, a pad, and a boot. The pad is assembled on the support frame to provide a cushioning surface between the support frame and the wearer's leg. The pad has ears in the knee section and in the ankle section, which serve to maintain the support frame and pad in proper alignment on the leg. The boot provides a non-slip, non-marring surface against the floor, when the wearer is working in a kneeling position. A moisture-absorbent liner, which is easily removed for cleaning or replaceable, may also be fitted on top of the pad, to provide an absorbent layer between the pad and the wearer's leg.

11 Claims, 4 Drawing Sheets

KNEE PAD

BACKGROUND INFORMATION

1. Field of the Invention

The invention relates to the field of knee pads. More particularly, the invention relates to knee pads mounted on a support frame that is strapped to the leg of a user.

2. Description of the Prior Art

Many types of installation and construction work require that a person spend an extended period of time in a kneeling position. For example, people who install carpeting or flooring typically work in a kneeling position on a hard surface. Knee pads are generally worn for such tasks, to protect the knees. Knee pad devices are known, that include a support frame and a pad and that protect not only the knee, but also the shin and ankle portions of the leg. U.S. Pat. Nos. 4,772,071 and 4,876,745 disclose such knee pad devices. These patents were issued to the inventor of the present application and their disclosures are incorporated herein by reference in their entirety.

One of the problems of conventional knee pad devices is that they do not stay properly aligned. So, for example, the knee or the ankle portion or both portions of the device may shift off to one side of the other. This is not only uncomfortable for the wearer, but also defeats the purpose of the device.

What is needed, therefore, is a knee pad device that will stay properly aligned.

BRIEF SUMMARY OF THE INVENTION

The invention is a knee pad to be used in conjunction with a knee-pad support frame. The knee pad has strap ears that are curved to better conform to the user's leg, when the support frame is strapped to the leg. The strap ears have détentes that receive the support-frame strap and serve to keep the strap properly aligned and centered on the user's leg.

BRIEF DESCRIPTION OF THE DRAWINGS

The present invention is described with reference to the accompanying drawings. In the drawings, like reference numbers indicate identical or functionally similar elements. The drawings are not to scale.

DETAILED DESCRIPTION OF THE INVENTION

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

Figure 1:
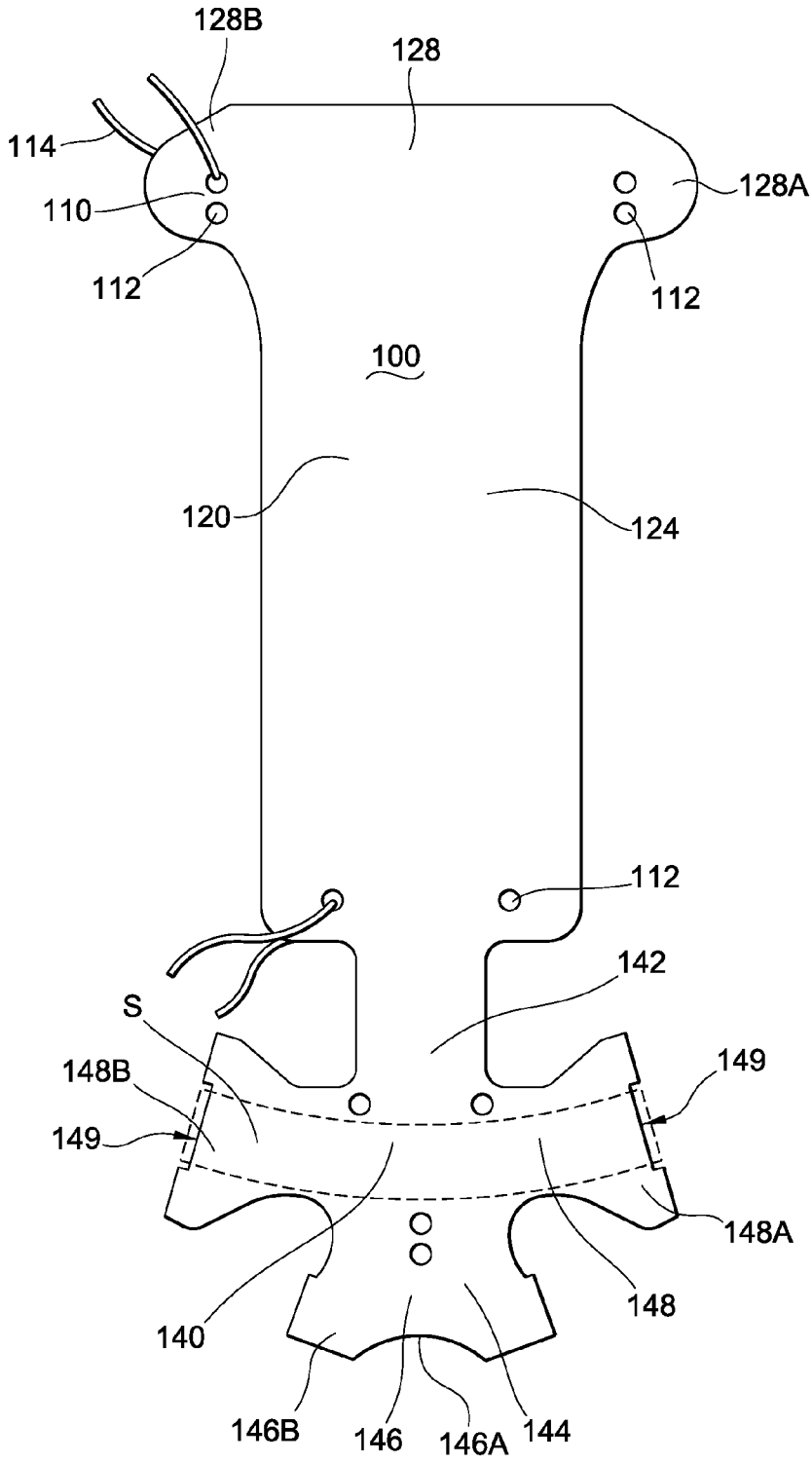
FIG. 1 is plane view of the knee pad according to the invention.
Figure 4:
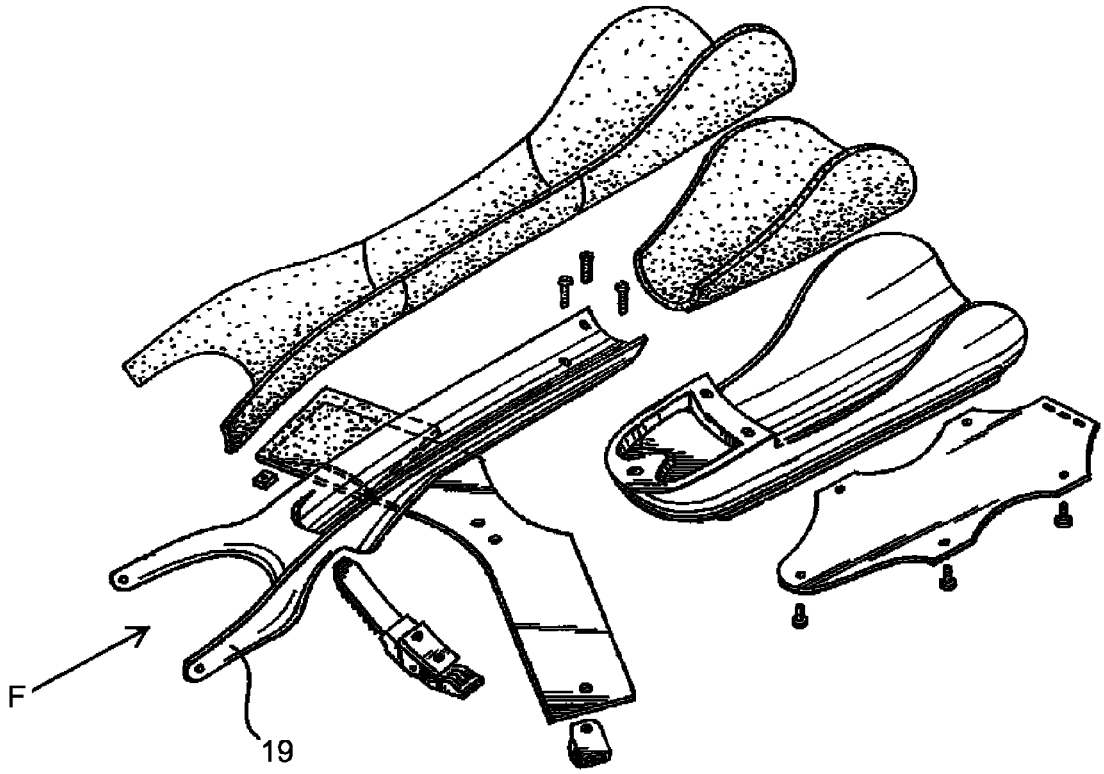
FIG. 4 (Prior Art)
FIG. 4 is an exploded view of a prior art knee pad with support frame, showing the prongs on the fork.

FIG. 1 illustrates a knee pad 100 according to the invention. The knee pad 100 is used in conjunction with a known support frame F, such as the support frame F described in U.S. Pat. No. 4,876,745, shown in FIG. 4. The support frame on which the knee pad 100 according to the invention is installed is very similar to the support frame F shown in FIG. 4, but has a truncated fork section. In other words, the prongs shown as "19" in the older frame have been shortened, so that the truncated fork section straddles the top of the user's boot, but prongs do not extend very far down the side of the boot. The support frame F has an inner surface, which is the surface that is placed up against the leg of the wearer, and an outer surface, which is the surface that is against the floor, when the wearer is working in a kneeling position. The knee pad 100 is assembled on the inner surface of the support frame F.

The knee pad 100 has an upper section 120 and a lower section 140. When installed in the support frame, the inner surface of the knee pad 100 is worn against the user's lower leg and ankle area, to cushion the knee, the lower leg, the ankle, and the top of the foot, when the user is kneeling. The upper section 120 cushions the area around the knee and just below the knee, and the lower section 140 cushions the area around the shin, the front of the ankle, and the top of the foot. The knee pad 100 is constructed of a cushioning material, such as foam or other padding material that absorbs impact shock and cushions the user against the discomfort of working on his knees on a hard floor. The thickness and material used for the knee pad 100 may vary, depending on the intended use and the density and other properties of the cushion material used.

The knee pad 100 has an attachment system 110 that allows it to be easily and securely mounted to the support frame, the attachment system including a through-bore 112 and a fastening device 114. As shown in FIG. 1, a plurality of through-bores 112 are provided along the edges of the knee pad 100. These through-bores 112 line up with bores provided on the support frame and align the knee pad 100 properly on the support frame. The fastening device 114 is any suitable means for attaching the knee pad 100 to the support frame, such as flexible, plastic straps that are threaded through the though-bore 112 and through the bore on the support frame and secured by some conventional means.

The upper section 120 of the knee pad 100 includes an upper shin section 124 and a knee section 128 having knee ears 128A and 128B. The upper section 120 is anchored to the support frame by means of the attachment system 110, such that the knee section 128 is centered on the support frame and the knee ears 128A and 128B extend outward to the side and upward, thereby providing the knee with some protection on the sides. These knee ears 128A and 128B, together with the support frame, also help center the knee pad 100 to the leg. The shin section 124 cushions the area of the leg below the knee and along the upper portion of the shin area.

Figure 2:
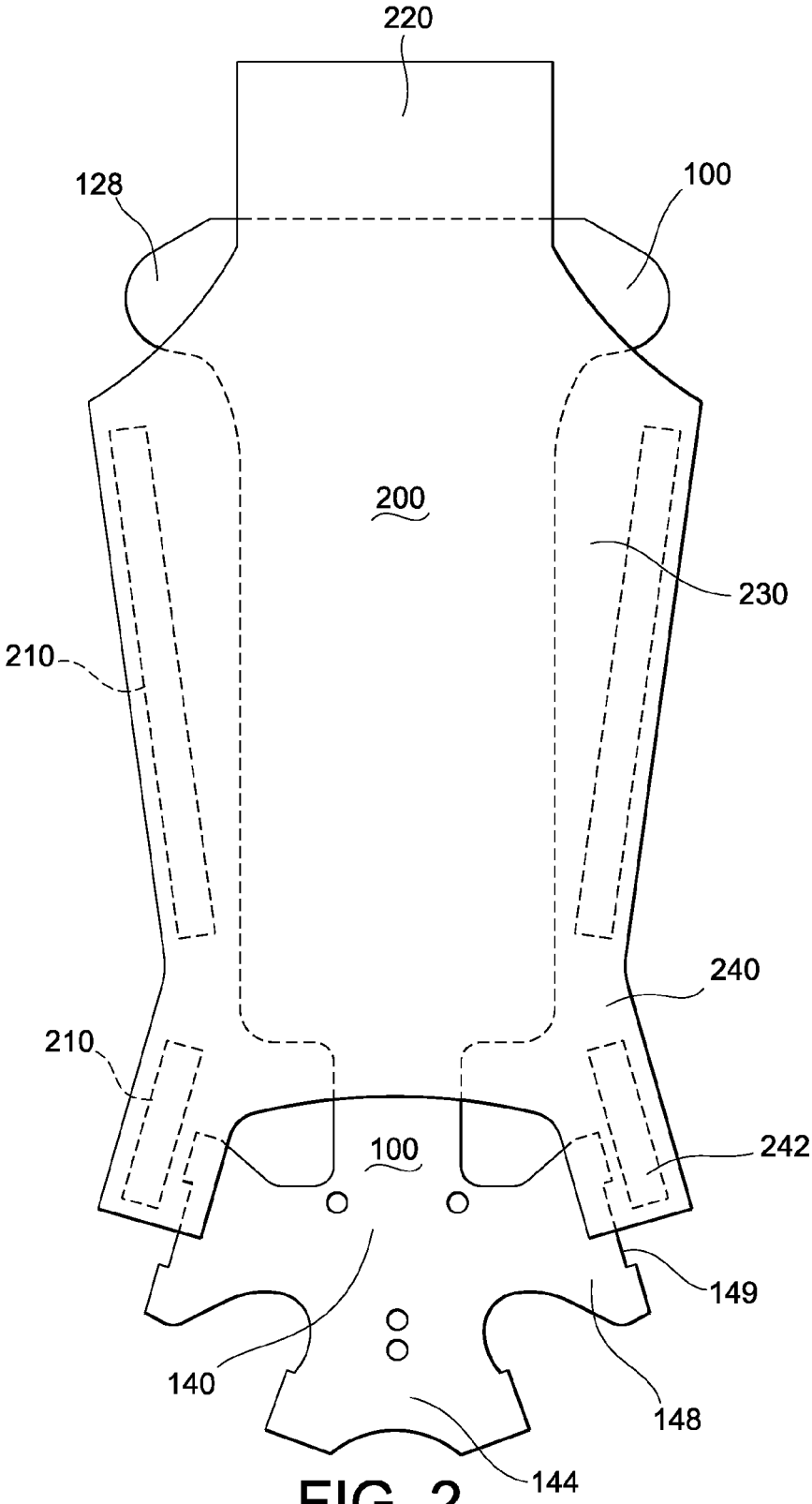
FIG. 2 is a plane view of a knee-pad liner, placed on top of the knee pad of FIG. 1.

The lower section 140 includes a lower shin section 142, an ankle section 144, and a strap pad 148. The ankle section 144 terminates in a truncated fork 146 that helps align the knee pad 100 properly above the user's foot. The truncated fork 146 has a foot recess 146A that straddles the user's foot at the ankle and ankle sides 146B that extend down along the sides of the foot. This allows normal flexion of the foot, yet also centers the knee pad 100 along the shin line of the user. The strap pad 148 has strap ears 148A and 148B, which wrap around the lower leg of the user in the area where a strap S, shown in dashed lines, wraps around the user's leg, to secure the frame and pad to the leg. The strap pad 148 cushions the lower leg against pressure from the support frame strap, allowing the strap to be pulled snugly about the leg, without causing discomfort. The strap ears 148A and 148B have a detent 149 that serves as a guide for the support frame strap S. As shown in FIGS. 1 and 2, the detent 149 is an indentation in the geometry of the strap ear 148A, 148B, that restricts movement of the support frame strap S in a longitudinal direction along the pad 100. The strap ears 148A and 148B, in conjunction with the truncated fork 146, keep the knee pad 100 properly aligned and prevent the entire support frame and knee pad 100 from twisting about the leg when being worn.

FIG. 2 illustrates a liner 200 that may be used with the knee pad 100. The liner 200 has an upper end 220 and a lower end 240. The lower end 240 of the liner 200 has fastener arms 242. The liner 200 is placed over the knee pad 100 such that the upper end 220 extends beyond the knee pad section 128 of the knee pad 100. This upper end 220 is wrapped around the upper edge of the knee pad 128 and secured in place between the knee pad 100 and the support frame. Hook fastener strips of a fabric hook-and-loop type fastener, also referred to as a fabric touch fastener, are provided along the sides and on the back of the support frame. The underside of the liner 200 is ideally a type of fabric that readily serves as the loop for the hook-and-loop type fastener. Alternatively, loop fastener strips 210 are provided on the underside of the liner 200, as shown in FIG. 2. The sides 230 of the liner 200 wrap around the sides of the knee pad 100 and fasten on the hook fastener strips provided on the sides of the support frame; the fastener arms 242 wrap around the lower end 140 of the knee pad 100 and fasten to the hook fastener strips provided on the back of the support frame.

The purpose of the liner 200 is to protect the knee pad 100 from debris, sweat, and grime. Ideally, the liner 200 is made of a cushioning material. The advantage of using a liner material that also serves as the loop portion of a hook-and-loop type fastener is that the liner 200 may be smoothed or slightly stretched across the surface of the knee pad 100 and fastened to the support frame, so that it remains free of wrinkles. As the material of the liner 200 stretches out from use, it may be re-positioned on the knee pad 100 and support frame to eliminate wrinkles.

Figure 3:
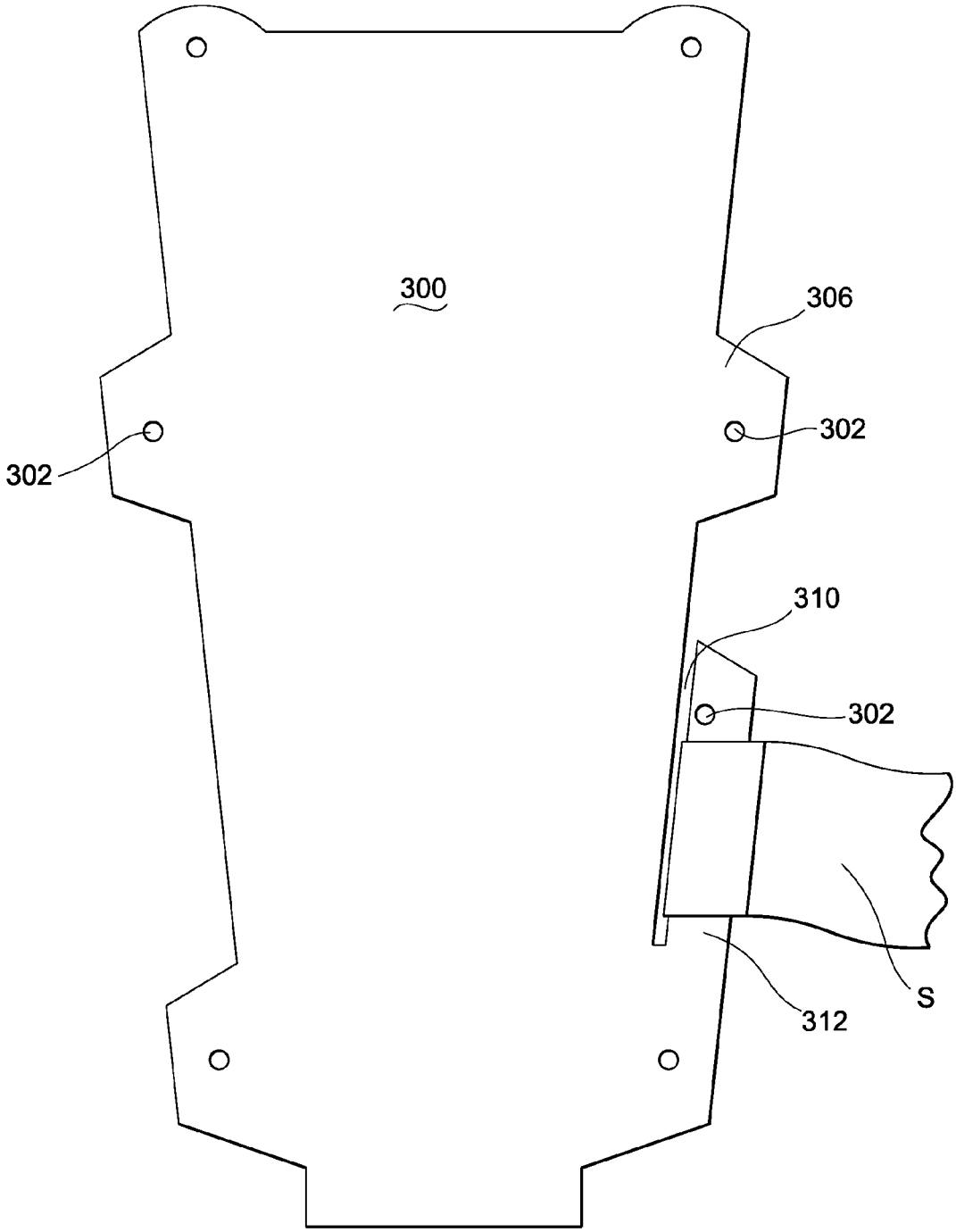
FIG. 3 is a plane view of the boot according to the invention.

FIG. 3 illustrates a boot 300 according to the invention, also to be used in conjunction with the support frame of the U.S. Pat. No. 4,876,745 cited above. The boot 300 provides a non-slip, non-marring, and replaceable bottom surface for the support frame and is a further improvement of the non-slip, non-marring layer 13 in the above cited patent. The boot 300 has a shape that corresponds to the shape of the lower surface of the support frame, with fastener ears 306. Through-bores 312 are placed at the fastener ears 306 for the purpose of anchoring the boot 300 to bottom of the support frame by conventional fastening means, such as with threaded fasteners that thread into threaded bores on the support frame. The boot 300 includes a slit 310 that is cut through the material to form an arm 312. The slit 310 allows a strap loop from the strap S to be slipped over the arm 312, which is then fastened to the support frame by means of conventional fasteners. The boot 300 is made from a material that ideally provides some resistance to sliding or skidding, prevents marring of the floor by the support frame, and is rugged and long-lasting. Suitable materials include leather, rubber (natural or synthetic), neoprene, and numerous other materials that provide the desired characteristics.

It is understood that the embodiments described herein are merely illustrative of the present invention. Variations in the construction of the pad and boot may be contemplated by one skilled in the art without limiting the intended scope of the invention herein disclosed and as defined by the following claims.

What is claimed is:

1. A device for protecting a leg, including a shin and a knee, and a front portion of an ankle of a wearer, said device comprising:

a support frame having an inner surface that is placed toward said wearer's leg and an outer surface that is against a floor, when said wearer is working in a kneeling position, and a support frame strap for securing said support frame to said wearer's leg; and a pad having an upper section that includes a knee section, a lower section that includes a lower shin section, an ankle section, and a strap section between said lower shin section and said ankle section, said pad having a longitudinal direction that extends between said knee section and said ankle section;

wherein said ankle section has a truncated fork, which, when said device is worn by said wearer, provides a recess formed by ankle sides, said recess being adapted to straddle an upper part of a foot at said ankle and said ankle sides extending downward along sides of said foot;

wherein said upper section has a width that covers a knee and an upper shin portion of the wearer's leg and said lower shin section has a width that is narrower than said upper section;

wherein said strap section has two strap ears, one strap ear extending outwardly on each side of said strap pad in a direction transverse to said longitudinal direction, such that a width of said strap section is wider than said width of said lower shin section, so as to allow said strap section to wrap about the wearer's leg just above said ankle, each said one strap ear having an outer edge that extends substantially in said longitudinal direction when said strap section is wrapped about the wearer's leg and a detent in said outer edge that serves as a guide for said support frame strap, and said width of said strap section serving as a cushion against the wearer's leg so as to allow said support frame strap to be snugly securable about said wearer's leg without causing discomfort; and wherein said pad is assemblable on said inner surface of said support frame and said support frame strap, when held in said detent of said two strap ears, together with said ankle section with said recess, serves to properly align said support frame and said pad on said leg.

2. The device of claim 1, wherein said knee section has two knee ears, one knee ear on each side of said pad, wherein said knee ears extend to the sides of a knee of said wearer and provide protection to said sides of said knee and further serve to align said support frame and said pad on said wearer's leg.

3. The device of claim 1, further comprising a liner that is placed over a surface of said pad that is facing toward said wearer's leg, wherein said liner is easily attachable and detachable from said support frame, so as to be replaceable.

4. The device of claim 3, wherein said liner is made of a moisture-absorbing, washable material.

5. The device of claim 3, wherein said liner is releasably fastenable to said support frame by means of a fabric touch-fastener.

6. The device of claim 1, wherein said pad is made of a cushioning material.

7. The device of claim 1, further comprising a boot that is assemblable on said outer surface of said support frame, so as to provide a protective cover on said support frame, said boot having fastener ears for anchoring said boot to said support frame.

8. The device of claim 7, wherein said boot is constructed of a rugged, non-marring material.

9. The device of claim 7, wherein said boot has a slit cut into it to form an arm, wherein one end of said support frame strap has a loop that is dimensioned to slip over said arm, so as to secure said support frame strap to said boot.

10. The device of claim 1, further comprising an attachment system for attaching said pad to said support frame, said attachment means comprising a plurality of through-holes through said support frame and a corresponding plurality of through-holes through said pad, and a fastening device that is insertable through said through-holes in said support frame and in said pad, to fasten said pad to said support frame.

11. The device of claim 10, wherein said fastening device is a flexible strap.

* * * * *